United States Patent [19]

Friedrich

[11] 4,375,747

[45] Mar. 8, 1983

[54] CONTROL SYSTEM FOR PRESSURE-DRIVEN LOADS

[75] Inventor: Richard Friedrich, Gauting, Fed. Rep. of Germany

[73] Assignee: Robert Bosch GmbH, Stuttgart, Fed. Rep. of Germany

[21] Appl. No.: 102,942

[22] Filed: Dec. 12, 1979

[30] Foreign Application Priority Data

Jan. 22, 1979 [DE] Fed. Rep. of Germany ..... 2902264

[51] Int. Cl.[3] ..... F15B 11/04

[52] U.S. Cl. ..... 60/433; 60/443; 60/469; 60/911

[58] Field of Search ..... 91/448, 459; 60/431, 60/469, DIG. 2, 443, 489, 493, 487, 433; 137/596.17; 251/129

[56] References Cited

U.S. PATENT DOCUMENTS

| | | | |
|---|---|---|---|
| 2,643,515 | 6/1953 | Harsch | 60/DIG. 2 |
| 3,593,523 | 7/1971 | Flaschar et al. | 60/DIG. 2 |
| 3,712,180 | 1/1973 | Pieper | 91/445 X |
| 3,946,284 | 3/1976 | Dieringer | 251/129 X |
| 3,952,509 | 4/1976 | Coleman | 60/DIG. 2 |
| 3,956,772 | 5/1976 | Cox | 251/129 X |
| 4,120,233 | 10/1978 | Heiser et al. | 91/459 X |

FOREIGN PATENT DOCUMENTS

| | | | |
|---|---|---|---|
| 2808694 | 9/1979 | Fed. Rep. of Germany . | |
| 1227035 | 3/1971 | United Kingdom | 60/431 |

*Primary Examiner*—Gerald A. Michalsky
*Attorney, Agent, or Firm*—Michael J. Striker

[57] ABSTRACT

A control system is disclosed for use with pressure-driven loads, such as reversible motors. The system allows the loads to be driven at varying speeds and also allows the loads to be reversed. However, the system is so designed that an operator cannot subject the loads to pressure shock caused by abrupt changes in pressure by adjusting the system too rapidly. The system disclosed is suitable for use with either hydraulic or pneumatic loads.

6 Claims, 2 Drawing Figures

CONTROL SYSTEM FOR PRESSURE-DRIVEN LOADS

BACKGROUND OF THE INVENTION

1. Field of the Invention

This invention pertains to a control system for use with pressure-driven loads, such as hydraulic or pneumatic motors or pistons. More particularly, this invention pertains to a control system which allows such loads to be reversed and which further allows the rate of operation of the loads to be controlled. Most specifically, this invention pertains to a control system for such loads which is designed for use with an adjustable-pressure pump which is non-reversible.

2. Background of the Prior Art

This type of control system is known and indeed in common use, especially when the pressure-driven load is a reversible hydraulic motor or piston. In known pressure-control systems, an operator can manually reverse the load by operating suitably connected valves which can reverse the direction of pressurized hydraulic fluid that passes through the load. Moreover, known control systems allow the rate of operation of such a load to be varied by adjusting a constriction valve which is in series with the load. Thus, using known control systems, both the direction of operation and the speed of operation of such a load may be varied by an operator.

However, in the event that an operator decides to abruptly change the direction of operation of such a load, or decides to abruptly change its operating speed, the load may be subjected to pressure shock. For example, in a hydraulic machine tool, an abrupt reversal of a hydraulic motor which is carrying a work piece will subject the motor to an immediate pressure shock when the quickly reversed hydraulic fluid is suddenly routed through the motor in an opposite direction. This pressure shock, if repeated, can rapidly damage and totally destroy the motor. Thus, it is desirable to provide a control system which does not subject such a motor or a load to such a pressure shock, even if an operator abruptly changes the direction in which the load is supposed to operate or even if he abruptly alters the speed at which it is supposed to operate.

SUMMARY OF THE INVENTION

Thus, it is the object of this invention to provide a control system for pressure-driven loads which protects the driven loads from pressure shock that results from abrupt reversal of operation of the load and further protects the load from such pressure shock which can occur as a result of abrupt changes in operating speed.

In order to accomplish these objectives, and others which will become apparent, this invention utilizes an electronic control system in which the load is not made directly responsive to the control which is adjusted by an operator. Rather, in this invention, a manually adjustable control produces a control signal which is then subjected to damping. The damped signal is the signal which is utilized to control the pressure applied to the load and the direction in which the pressure is applied. The damping is accomplished by an electronic damper which produces a damped signal that cannot vary faster than some predetermined rate. In the event that an operator adjusts the controls slowly, the damped signal will vary directly as the variations in the control. However, in the event that an operator adjusts the control abruptly, the damper smoothes out the rapidly varying control signal by producing a damped signal which does not vary as rapidly as the control signal. Thus, a built-in time delay exists in this invention which prevents an operator from pressure-shocking a load by too-abrupt adjustment of the control.

In a preferred embodiment of this invention, the system utilizes a directional servo which can change the direction in which the pressure is applied to the load. In this embodiment, the directional servo not only has a forward state in which the pressure is applied to drive the load in a forward direction and a reversed state in which pressure is applied to drive the load in a reversed direction, but also has an off state which is always assumed whenever the direction of operation of the load is to be reversed. As will be seen hereinafter, such a directional servo momentarily stops pressure from being applied to the load during the reversing process, and thus gives the load a period of time to slow down prior to being subjected to pressure in a reversed direction.

The novel features which are considered as characteristic for the invention are set forth in particular in the appended claims. The invention itself, however, both as to its construction and its method of operations, together with additional objects and advantages thereof, will be best understood from the following description of specific embodiments when read in connection with the accompanying drawing.

DETAILED DESCRIPTION OF PREFERRED EMBODIMENTS

Figure 1:
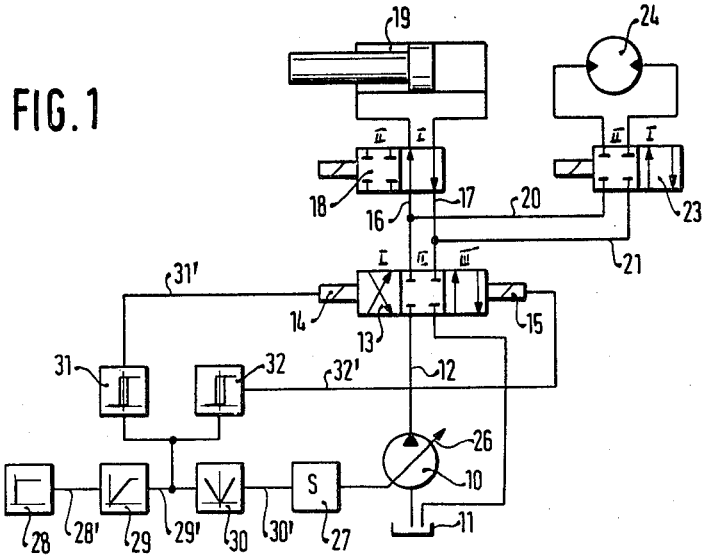
FIG. 1 is a schematic diagram of an embodiment of this invention.
Figure 2:
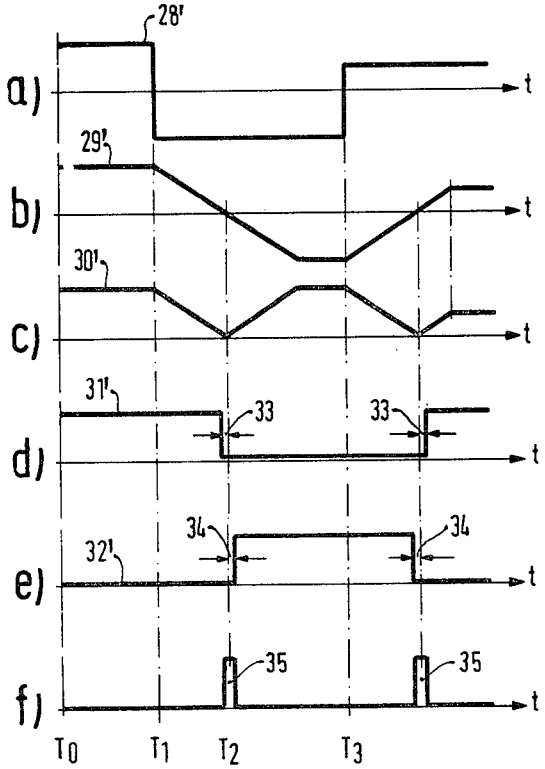
FIGS. 2(*a*)-(*f*) are graphs showing the electrical signals generated within the invention as a function of time when the direction of operation of a load is to be reversed.

Referring to FIG. 1 of the drawings, it can be seen that reference numeral 28 denotes a manually adjustable control which can be adjusted by an operator. The control produces a control signal, which here is given a reference numeral 28'. The control signal 28' is a DC signal which can continuously vary between a maximum voltage and a minimum voltage which have the same magnitude but are of opposite senses. In other words, control voltage 28' can vary between +V and −V. Referring now to FIG. 2(*a*), it can be seen that at time $T_o$, the control 28 is adjusted to a position in which, as will be seen hereinafter, the loads are run forwardly. Some time later, at time $T_1$, the operator abruptly re-adjusts control 28 in order to attempt to cause the loads to operate at a like speed but in the opposite direction. In other words, the operator attempts to re-adjust the control system so as to ordinarily cause a pressure shock to be applied to the loads. In this case, the slope of the graph shown in FIG. 2(*a*) is the measure of the abruptness with which the operator attempts to re-adjust the load.

However, as can be seen from FIG. 1, control signal 28' does not itself directly operate the rest of the system. Rather, control signal 28' is fed into wave-shaper 29. Shaper 29 can be viewed as either a ramp generator or, alternatively, a network with a comparatively slow response time. Shaper 29, when the variation of signal 28′ is less than or equal to some predetermined rate, will produce a shaped signal 29′ which is the same in amplitude as control signal 28′. However, when control signal 28′ varies at a rate exceeding this predetermined rate, as in the case of control signal 28′ at time $T_1$, shaper 29 produces a signal 29′ which does not drop in voltage as rapidly as does control signal 28′. In fact, it can be seen that signal 29′ only reaches 0 at time $T_2$ which is later than $T_1$, and only reaches the negative voltage of control signal 28′ at an even later time $T_3$. Hence, it may be seen from FIG. 2(*b*) that the shaper 29 extends the time during which the direction of operation and speed of operation of the loads are to change.

Referring now to FIG. 1 in more detail, it can be seen that it is the shaped signal 29′ which actually serves to operate the system herein. Shaped signal 29 is utilized in two fashions: its magnitude determines the speed at which the loads are to operate, and its direction determines the direction in which the loads are to operate. Thus, the rest of the electronics control system is divided into two sub-systems: a directional sub-system and a pressure sub-system.

The pressure sub-system, which operates according to the magnitude of shaped signal 29′, includes a full-wave rectifier 30 which produces an electric pressure signal 30′, which in turn is fed into pressure servo 27. It can be seen from FIG. 2(*b*) and FIG. 2(*c*) that pressure signal 30′ has a magnitude always to equal to the magnitude of shaped signal 29′ but, in contrast thereto, always has a positive magnitude.

Referring now to FIG. 1, it can be seen that pressure signal 30′ operates pressure servo 27 to vary the pressure produced in the hydraulic system. In this embodiment, pressure servo 27 operates an element 26 which varies the pressure output of an adjustable and non-reversible pump 10. However, it should be noted that servo 27 may for example operate a constrictor valve connected in series with a pump that has a non-variable output. Thus, it can be seen that the pressure sub-system shown in this embodiment includes full-wave rectifier 30 feeding pressure servo 27, which servo may vary the hydraulic pressure in the rest of the system by any suitable means, which means can include varying the output of a variable pump or may include varying the constriction of a contrictor valve.

It can be seen from FIG. 2(*a*) that a desired change in the direction of operation of the loads must be characterized by the passage of control signal 28′ through V=0. Further, it can be seen that, as is shown in FIG. 2(*b*), such a passage of control signal 28′ through 0 is followed by a like passage of shaped signal 29′ through 0. Hence, the directional sub-system of this invention operates by monitoring the shaped signal 29′, and recognizing that when shaped signal 29′ approaches and passes through 0, that a change in load operation direction is desired. For this purpose, complimentary Schmidt triggers 31 and 32 are used. These two triggers 31 and 32 essentially form a flip-flop in which the output signals 31′ and 32′ never occur simultaneously. In the example shown, trigger 31 is on at $T_o$ and trigger 32 is off at that time, so that trigger 31 produces an output signal 31′ which is on while trigger 32 produces an output signal 32′ which is off. After shaped signal 29′ has passed through 0, the situation is reversed and trigger 31 has an output signal 31′ which is off while trigger 32 has an output signal 32′ which is on. Thus, it can be seen that the two complimentary triggers 31 and 32 correspondingly change their states each time that shaped signal 29′ passes through 0.

The consequences of such changes in output signals 31′ and 32′ are corresponding changes in the state of 3-position solenoid valve 13. Solenoid valve 13 has a forward state (denoted as I in FIG. 1) a reverse state (denoted as III in FIG. 1) and an off state (denoted as II in FIG. 1). When the solenoid 13 is in its forward state, feed line 12 is connected to line 17 and tank 11 is connected to line 17 and tank 11 is connected to line 16. When the solenoid 13 is in its reverse state, feed line 12 is connected to line 16 and line 17 is connected to tank 11. When the solenoid 13 is in its off state, no lines are connected at all. Although the actual operation of these lines will be discussed hereinafter, it is only important to note at this point that solenoid 13 is placed in its forward state by energization of electromagnet 14, is placed in its reverse state by magnetization of electromagnet 15, and is placed in its off state when neither electromagnet 14 nor electromagnet 15 is energized. Hence, when reference is had to FIGS. 2(*d*) and (*e*), it can be seen that at time $T_1$ the solenoid 13 is in its forward state because electromagnet 14 is energized by signal 31′ produced by trigger 31, while at time $T_3$, electromagnet 15 is energized by signal 32′ generated by trigger 32, and the solenoid 13 is then in its reverse state.

It will be obvious to one skilled in the art that if triggers 31 and 32 were biased to flip-flop when shaped signal 29′ were exactly equal to 0, that solenoid 13 would either be in its forwards state or its reversed state, and would switch between the states instantaneously. As will be seen hereinafter, such instantaneous switching would subject the loads to pressure shock. Thus, trigger 31 is biased to turn off at a voltage slightly greater than 0, and trigger 32 is biased to turn on at a voltage slightly less than 0. Hence, as can be seen in FIG. 2(*e*), there will exist a small interval 35 which intervenes between the flipping-flopping of the two triggers. In this interval, neither electromagnet 14 nor electromagnet 15 is energized, because within this interval both signals 31′ and 32′ are off. Hence, during this interval, the solenoid 13 is in its off state. In sum, it may now be seen that the triggers 31 and 32 are so biased that the solenoid 13 must now assume its off state intermediate a change of state from forward to reverse and vice-versa.

Referring once again to FIG. 1, it can be seen that hydraulic pump 10 draws hydraulic fluid from tank 11 and forces it through main feed line 12. Feed line 13 is one of the lines which is switched by solenoid valve 13. When solenoid valve 13 is placed in its forward state, feed line 12 is connected to line 17 in order to operate the loads hereinafter described in a forward direction. The return hydraulic fluid, after having driven the loads, is then routed through line 16 which is connected to tank 11 by solenoid valve 13. It can thus be seen that when the solenoid valve 13 is in its forward position, both loads are driven in a forward direction. When the direction of operation of operation of the loads 19 and 24 is to be reversed, solenoid valve 13 first passes through its off state and disconnects the loads 19 and 24 from the pump 10. Subsequently, when the solenoid valve 13 is placed in its reverse state, the direction of flow of hydraulic fluid through lines 16 and 17 is reversed, causing the loads 19 and 24 to be operated in a reverse direction. Moreover, it can be seen that load 19, which is a reversible hydraulic cylinder, is attached to lines 16 and 17 through solenoid valve 18, whereas reversible motor 24 is connected in parallel with cylinder 19 by lines 20 and 21 which are, respectively, tapped off lines 16 and 17 and passed through solenoid valve 23. Hence, in the embodiment shown in FIG. 1, the cylinder 19 and motor 24 can be operated independently of each other by operation of solenoid valves 18 and 23. Because of the arrangement of the lines shown in the drawing, it will also appear that although the cylinder 19 and motor 24 can be turned on and off independently of each other, they will always move in corresponding directions, i.e. when cylinder 19 is moving to the left as is viewed in FIG. 1, the motor 24 will always rotate in, e.g., a counter-clockwise direction, while movement of cylinder 19 to the right as is seen in FIG. 1 will always be accompanied by rotation of motor 24 in a clockwise sense.

In sum, the control system disclosed herein prevents an operator from subjecting the loads 19 and 24 to excessive changes in operating pressure in short periods of time. If the operator adjusts control 28 so as to call for an excessively rapid change in operating pressure, or an abrupt reversal of operating direction of cylinder 19 and motor 24, the control system will delay such changes over longer periods of time so as not to suddenly subject cylinder 19 and motor 24 to excessive changes in pressure. Thus, pressure shock to these two loads is avoided. It should be noted that in the event solenoid valve 13 only drives one load, that an intervening solenoid valve between that load and solenoid valve 13 is superfluous.

It will be understood that each of the elements described above, or two or more together, may also find a useful application in other types of construction differing from the types of described above. For example, a pneumatic system rather than a hydraulic one may be used.

While the invention has been illustrated and described as embodied in "CONTROL SYSTEM FOR PRESSURE-DRIVEN LOADS", it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic of specific aspects of this invention.

What is claimed as new and desired to be protected by Letters Patent is set forth in the appended claims:

1. A manually operable control system for use with at least one reversible pressure-driven load which can be operated at variable pressures, the system allowing the pressure to be continuously varied and further allowing the load to be reversed while protecting the load from pressure shock resulting from reversal and from abrupt variation in pressure, comprising:

a reversible pressure-driven load;

a directional servo responsive to a directional signal and connected in series with the load, the directional servo having a forward state and a reverse state, the directional servo applying pressure to the load in such a manner that the load operates in a forward direction when the directional servo is the forward state and the load operates in a reverse direction when the directional servo is in a reverse state;

an adjustable pressure servo responsive to an electrical pressure signal, the pressure servo including a pump of a variable-pressure and non-reversible type having its output connected in series with the directional servo and continuously varying the pressure applied thereto as a function of the electrical pressure signal;

a manually adjustable control producing a continuous electrical control signal with a voltage which varies with time between a maximum value and a minimum value which have equal magnitudes and opposite senses as a function of the adjustment of the control;

a signal shaper connected to the control and responsive to the control signal, the shaper producing an electrical shaped signal which varies between said values as the output signal when the variation of the output signal with time at most equals a predetermined rate, and which further varies at said predetermined rate when the variation of the output signal with time is greater than said predetermined rate;

a directional discriminator responsive only to the sense of the shaped signal and producing an electrical directional signal, the directional discriminator being connected to and cooperating with the directional servo to place the directional servo in its forward state when the shaped signal is in one sense and to place the directional servo in its reverse state when the shaped signal is in an opposite sense; and a pressure monitor responsive only to the magnitude of the shaped signal and producing the continuous electrical pressure signal in response thereto which varies with time directly as said magnitude varies with time, the pressure monitor being connected to and cooperating with the pressure servo, whereby the pressure is varied as a function of the magnitude of the shaped signal.

2. The control system defined in claim 1, wherein the directional servo further has an off state in which the pressure is disconnected from the load, and wherein the directional discriminator and the directional servo cooperate in a manner that the directional servo is momentarily placed in the off state when the sense of the damped signal changes, and further cooperate in a manner that the directional servo is always placed in the off state intermediate a transition between one of the forward and reverse states and another one of the forward and reverse states.

3. The control system defined by claim 2, wherein the pressure is exerted by a hydraulic fluid which is pressurized by the pressure servo.

4. The control system defined by claim 2, wherein the directional servo is a three position solenoid-operated valve.

5. The control system defined by claim 2, wherein the directional discriminator includes a full-wave rectifier and two complementary Schmidt triggers.

6. The control system defined by claim 5, wherein the Schmidt triggers are biased to trigger at non-zero voltages.

* * * * *